US006894015B1

(12) United States Patent
Briatore et al.

(10) Patent No.: US 6,894,015 B1
(45) Date of Patent: May 17, 2005

(54) BLEACHING COMPOSITIONS

(75) Inventors: Andrea Briatore, Rome (IT); Michael Alan John Moss, Rome (IT); Oreste Todini, Rome (IT)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/831,192

(22) PCT Filed: Nov. 10, 1999

(86) PCT No.: PCT/US99/26588

§ 371 (c)(1),
(2), (4) Date: May 7, 2001

(87) PCT Pub. No.: WO00/27978

PCT Pub. Date: May 18, 2000

(30) Foreign Application Priority Data

Nov. 10, 1998 (EP) ..... 98870247
Dec. 2, 1998 (EP) ..... 98870263

(51) Int. Cl.[7] ..... C11D 7/26; C11D 7/38; C11D 7/54

(52) U.S. Cl. ..... 510/303; 510/309; 510/310; 510/361; 510/372; 510/476; 510/477; 510/488; 510/505

(58) Field of Search ..... 510/303, 307, 510/309, 310, 325, 361, 372, 394, 476, 477, 488, 505

(56) References Cited

U.S. PATENT DOCUMENTS

| | | | | | |
|---|---|---|---|---|---|
| 5,384,061 | A | * | 1/1995 | Wise | 252/95 |
| 5,510,047 | A | * | 4/1996 | Gabriel et al. | 252/89.1 |
| 5,641,739 | A | * | 6/1997 | Kott et al. | 510/372 |
| 5,880,079 | A | * | 3/1999 | Polotti et al. | 510/309 |
| 6,103,683 | A | * | 8/2000 | Romano et al. | 510/383 |
| 6,235,699 | B1 | * | 5/2001 | Del Duca et al. | 510/375 |
| 2002/0112295 | A1 | * | 8/2002 | Gagliardi et al | 8/115.51 |
| 2003/0083222 | A1 | * | 5/2003 | Raso et al. | 510/463 |

FOREIGN PATENT DOCUMENTS

| | | | |
|---|---|---|---|
| EP | 668345 | * | 8/1995 |
| EP | 0 668 345 A1 | | 8/1995 |
| EP | 558 345 B1 | | 6/1997 |
| EP | 558345 | * | 6/1997 |
| GB | 2 279 963 A | | 1/1995 |
| GB | 2279963 | * | 1/1995 |
| WO | WO 99/15616 | | 4/1999 |

* cited by examiner

*Primary Examiner*—Gregory R. Del Cotto
(74) *Attorney, Agent, or Firm*—James F. McBride; Kim W. Zerby; Steven W. Miller

(57) ABSTRACT

The present invention relates to cleaning compositions which comprise radical scavengers, for effective cleaning and improved storage stability. These compositions are suitable for use in various laundry applications including hand and machine laundry methods.

20 Claims, No Drawings

BLEACHING COMPOSITIONS

FIELD OF THE INVENTION

The present invention relates to cleaning compositions suitable for use in various laundry applications including hand and machine laundry methods, comprising a radical scavenger.

BACKGROUND OF THE INVENTION

Cleaning compositions are well known in the art. Such compositions generally comprise a number of active components that provide the cleaning function of the composition. When selecting components of the composition, it is therefore preferred that the components are stable in the composition so as not to lose cleaning effectiveness. In certain instances however, some ingredients of a cleaning composition for example oxidising agents can decompose leading to a reduction in the concentration of oxidising agent over time and consequently to the reduction of the cleaning and whitening performance of the composition.

Cleaning compositions can also comprise, in addition to the oxidising agent, a number of other components that provide additional cleaning and whitening performance benefits. When selecting components of the composition, it is preferred that the components are stable in the composition, i.e., do not react with the oxidising agent, further reducing the concentration of oxidising agent in the composition. In certain instances however, the reaction or interaction of components of the composition with the oxidising agent is inevitable. As a consequence of this, the premature decomposition of the oxidising agent and the other actives present in the composition occurs, leading to the reduction of the cleaning and/or whiteness effectiveness of the composition.

Although not wishing to be bound by theory, it is believed that decomposition of the oxidising agent and the interaction or reaction of the different ingredients of the composition with the oxidising agent can proceed via one electron and/or two electron chemistry. One electron chemistry reactions are initiated by the formation of radicals from the parent oxidising agent. Generally, the radicals formed are more reactive and better oxidising species than the parent and thus accelerate the decomposition kinetics of the oxidising agents and its reaction or interaction with the other actives ingredients present in the composition. Thereby enhancing the decomposition of the oxidising agent and the other actives ingredients. For example, where brighteners are components of the composition, decomposition thereof can be initiated by one and/or two electron processes, resulting in the loss or decreased of whiteness performance benefit, normally expected when incorporating a brightener. The brightener oxidation via one electron processes is believed to proceed faster than the two electron oxidation. To improve the compatibility of the oxidising agent with the other actives, it is therefore important to reduce, slow down or completely suppress one electron oxidation chemistry reactions.

The Applicant has thus now surprisingly found that this problem is solved by formulating a liquid bleaching composition according to the present invention. EP-A-558345 discloses hypochlorite-containing compositions comprising a source of strong alkalinity, a pH buffering means (silicate/carbonate) and radical scavengers. The radical scavengers of the present invention are not disclosed therein. Furthermore, it has been found that compositions of the present invention are stable on storage and provide improved whiteness and cleaning performance in any laundry application even on ageing of the composition, i.e. when used after prolonged periods of storage, as compared to the whiteness and cleaning performance delivered by the same composition under the same conditions but without any radical scavenger. More particularly, it has been found that the stability of the oxidising agent and/or the other actives ingredients (where present), are improved when the radical scavenger of the present invention is present versus when it is not.

A further advantage of the compositions of the present invention is that they are suitable for the cleaning of different types of fabrics including natural fabrics (e.g., fabrics made of cotton, viscose, linen, silk and wool), synthetic fabrics such as those made of polymeric fibers of synthetic origin as well as those made of both natural and synthetic fibers.

Yet, another advantage of the liquid bleaching compositions of the present invention is that said bleaching compositions are suitable for various laundry cleaning applications both when used in diluted conditions, e.g. as a detergent additive of a fully formulated laundry detergent composition, and when used in neat condition, e.g. as a liquid pretreater (spotter).

SUMMARY OF THE INVENTION

The present invention relates to a liquid cleaning composition comprising an oxidising agent and a radical scavenger which is selected from the group consisting of:

(i)

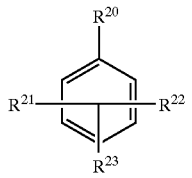

wherein $R^{20}$ is the moiety —COOM or —$SO_3M$, wherein M is hydrogen or a metal; $R^{21}$ and $R^{22}$ are each independently hydrogen, $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof; $R^{23}$ is —OR' wherein R' is $C_1$–$C_{20}$ linear or branched alkyl.

(ii)

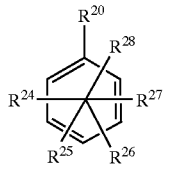

wherein $R^{20}$ is the moiety —COOM or —$SO_3M$, wherein M is hydrogen or a metal; $R^{24}$,$R^{25}$,$R^{26}$, and $R^{27}$ are each independently $C_1$–$C_{10}$ linear or branched alkyl, —OR' wherein R' is $C_1$–$C_{20}$ linear or branched Alkyl, —COOM, —$SO_3M$, —Cl, —Br, —$NO_2$, and mixtures thereof; $R^{28}$ is hydrogen, $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof;

(iii)

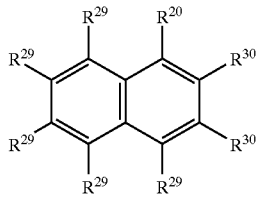

wherein $R^{28}$ is the moiety —COOM or —$SO_3M$, wherein M is hydrogen or a metal, each $R^{29}$ is independently $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof; each $R^{30}$ is independently hydrogen, $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof.

(iv) homopolymers or copolymers comprising units having the formula:

a)

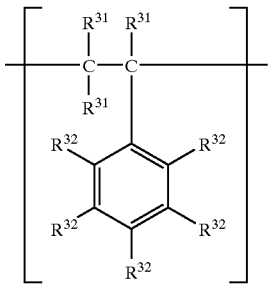

b)

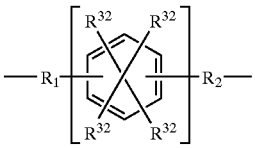

c)

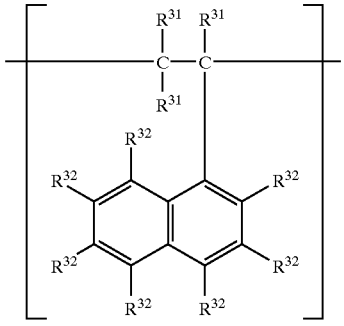

-continued d)

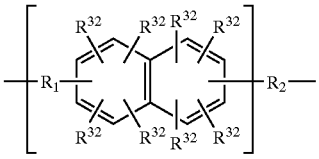

wherein $R^{31}$ is the moiety hydrogen, $C_1$–$C_{10}$ linear or branched alkyl, —OR' wherein R' is $C_1$–$C_{20}$ linear or branched alkyl, —OH, —COOM, —$SO_3M$, —Cl, —Br, —$NO_2$, and mixtures thereof; wherein M is hydrogen or a metal; each $R^{32}$ is independently hydrogen, $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof; $R_1$ and $R_2$ are each independently selected from —$C(R^{31})_2$—, —CO—, —C(O)O—, —C(O)NH—, —O—, —$N(R^{31})_2$—;

(v) and mixtures thereof.

In a preferred embodiment the compositions of the present invention further comprise on or more surfactants and or a brightener.

DETAILED DESCRIPTION OF THE INVENTION

Liquid Cleaning Compositions:

The compositions according to the present invention are in liquid form. Preferably, the compositions of the present invention are thickened. Thickening can be achieved by the addition of thickening components for example surfactants, more particularly anionic surfactants. Preferably the compositions are in aqueous form. More preferably, they comprise water in an amount of from 60% to 98% by weight, more preferably of from 80% to 97% and most preferably of from 85% to 97% by weight of the total aqueous liquid bleaching composition.

Oxidising Agent:

The oxidising agent of the present invention can be any known oxidising agent. Suitable oxidising agent include peroxygen or hypohalite bleaching agent.

Suitable peroxygen bleaches to be used herein are hydrogen peroxide, water soluble sources thereof, or mixtures thereof. As used herein a hydrogen peroxide source refers to any compound that produces perhydroxyl ions when said compound is in contact with water. Suitable water-soluble sources of hydrogen peroxide for use herein include percarbonates, persilicates, persulphates such as monopersulfale, perborates, peroxyacids such as diperoxydodecandioic acid (DPDA), perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance when used in any laundry application.

Suitable aliphatic diacyl peroxides for use herein are dilauroyl peroxide, didecanoyl peroxide, dimyristoyl peroxide, or mixtures thereof. Suitable aromatic dicayl peroxide for use herein is for example benzoyl peroxide. Such diacyl peroxides have the advantage to be particularly safe to fabrics and color while delivering excellent bleaching performance when used in any laundry application.

Preferably the oxidising agent of the invention is a hypohalite bleach. Hypohalite bleaches may be provided by a variety of sources, including bleaches that are oxidative bleaches and subsequently lead to the formation of positive halide ions as well as bleaches that are organic based sources of halides such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chlorcimides, N-chloroamides, N-chloroamines and chlorohydantoins.

Particularly preferred oxidising agents of the present invention are the alkali metal and/or alkaline earth metal hypochlorites selected from the group consisting of sodium, potassium, magnesium, lithium and calcium hypochlorites, and mixtures thereof. Most preferably the oxidising agent is sodium hypochlorite.

Preferably, the liquid compositions according to the present invention comprise said oxidising agent such that the content of active oxidising agent in the composition is from 0.1% to 20% by weight, more preferably from 0.25% to 8% by weight, most preferably from 0.5% to 6% by weight of the composition.

The Radical Scavenger

The compositions of the present invention comprise a radical scavenger. The radical scavenger suitable for use herein is selected from one or more of the categories as listed below. Hence, the radical scavenger may be selected from one category as listed below or may be a mixture of radical scavengers from one category or in fact may be a mixture of radical scavengers selected from more than one category.

The radical scavengers of the present invention are described in four categories. The first category of radical scavengers (i) has the general formula:

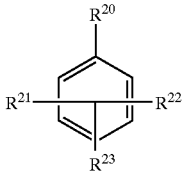

wherein $R^{20}$ is the moiety —COOM or —$SO_3M$, wherein M is hydrogen or a metal; $R^{21}$ and $R^{22}$ are each independently hydrogen. $C_1$–$C_{10}$ linear or branched alkyl, —OR' wherein R' is $C_1$–$C_{20}$, linear or branched alkyl, —COOM, —$SO_3M$, —Cl, —Br, —$NO_2$, and mixtures thereof; $R^{23}$ is —OR' wherein R' is $C_1$–$C_{20}$ linear or branched alkyl.

The second category of radical scavengers (ii) has the general formula:

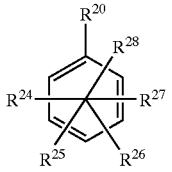

wherein $R^{20}$ is the moiety —COOM or —$SO_3M$, wherein M is hydrogen or a metal. $R^{24}$, $R^{24}$, $R^{26}$, and $R^{27}$ are each independently $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof; $R^{28}$ is hydrogen, $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof.

The third category of radical scavengers (iii) has the general formula:

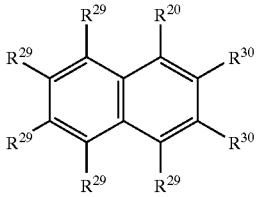

wherein $R^{20}$ is the moiety —COOM or —$SO_3M$, wherein M is hydrogen or a metal, each $R^{29}$ is independently $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof; each $R^{30}$ is independently hydrogen, $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof;

The fourth category of radical scavengers (iv) are homopolymers of copolymers comprising units having the formula:

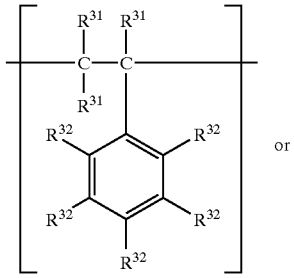

or

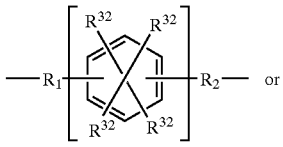

or

-continued

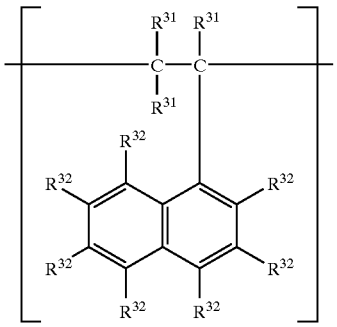

or

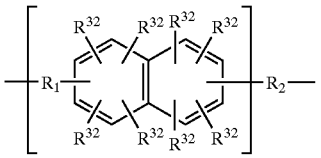

wherein $R^{31}$ is the moiety hydrogen. $C_1$–$C_{10}$ linear or branched alkyl, —OR' wherein R' is $C_1$–$C_{20}$ linear or branched alkyl. —OH, —COOM, —$SO_3M$, —Cl, —Br, —$NO_2$, and mixtures thereof; wherein M is hydrogen or a metal; each $R^{32}$ is independently hydrogen, $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof; $R_1$ and $R_2$ are each independently selected from —$C(R^{31})_2$—, —CO—, —C(O)O—, —C(O)NH—, —O—, —$N'(R^{31})_2$.

Preferred radical scavengers are selected from the group consisting of 2,3,4,5 tetramethoxy benzoic acid; 2,3,4,5,6-pentamethoxy benzoic acid; polystyrene; polystyrene sulfonate, styrene; malic acid copolymer; styrene:acrylic acid copolymer; styrene:ethylene glycol graft polymer; poly (ethyleneglycol) di-toluene sulfonate; poly hydroxy benzoic acid; polyhydroxy styrene; poly methyl styrene; polystyrene divinyl benzene; poly vinyl phenol; and mixtures thereof.

The compositions of the present invention comprise from 0.001% to 10% by weight of the total composition of a radical scavenger, or a mixture thereof. preferably from 0.01% to 8%, more preferably from 0.1% to 6% and most preferably from 0.2% to 4%.

Alternatively, the compositions of the present invention may comprise a mixture of the radical scavengers or a combination of at least one radical scavenger of the present invention and another radical scavenger known in the art or those described in the Applicants co-pending application number 97870139.9-2108.

Advantageously, the compositions of the invention are stable on storage. By "stable on storage", it is to be understood that the compositions of the present invention typically do not undergo more than 25% loss of available oxidising agent after 5 days of storage at 50° C.±0.5° C. and more preferably not more than 20%. The % loss of available chlorine may be measured using the method described, for instance, in "Analyses des Eaux et Extraits de Javel" by "La chambre syndicale nationale de L'eau de Javel et des produits connexes", pages 9–10 (1984). Said method consists in measuring the available oxidising agent in the fresh compositions, i.e. just after they are made, and in the same compositions after 5 days at 50° C.

Brightener

A preferred optional component of the invention is a brightener. Any brightener known in the art may be used herein including both hydrophobic and hydrophilic brighteners and mixtures thereof.

Brighteners are compounds which have the ability to fluoresce by absorbing ultraviolet wave-lengths of tight and re-emitting visible light. Brighteners, also referred to as fluorescent whitening agents (FWA), have been extensively described in the art, see for instance EP-A-0 265 041, EP-A-0 322 564, EP-A-0 317 979 or "Fluorescent whitening agents" by A. K. Sarkar, published by MERROW, especially page 71–72.

Commercial optical brighteners which may be useful in the present invention can be classified into subgroups, which include, but are not necessarily limited to, derivatives of stilbene, pyrazoline, coumarin, carboxylic acid, methinecyanine, dibenzothiophene-5,5-dioxide, azole, 5- and 6-membered-ring heterocycle, and other miscellaneous agents. Examples of such brighteners are disclosed in "The Production and Application of Fluorescent Brightening Agents", M. Zahradnik, Published by John Wiley & Sons, New York (1982). Further optical brighteners which may also be used in the present invention include naphthlimide, benzoxazole, benzofuran, benzimidazole and any mixtures thereof. Particularly preferred brighteners for use herein are the derivatives of stilbene and mixtures thereof.

Examples of optical brighteners which are useful in the present compositions are those identified in U.S. Pat. No. 4,790,856. These brighteners include the PHORWHITE® series of brighteners from Verona. Other brighteners disclosed in this reference include: Tinopal-UNPA®, Tinopal CBS® and Tinopal 5BM® available from Ciba-Geigy; Artic White CC® and Artic White CWD®; the 2-(4-styryl-phenyl)-2H-naptho[1,2-d]triazoles; 4,4'-bis(1,2,3-triazol-2-yl)-stilbenes; 4,4'-bis(styryl)bisphenyls; and the aminocoumarins.

Specific examples of brighteners useful herein include 4-methyl-7-diethyl-amino coumarin; 1,2-bis(-benzimidazol-2-yl)ethylene; 1,3-diphenyl-pyrazolines; 2,5-bis (benzoxazol-2-yl)thiophene; 2-styryl-naptho-[1,2-d] oxazole; 2-(stilbene-4-yl)-2H-naphtho[1,2-d]triazole, 3-phenyl-7-(isoindolinyl) coumarin; 3-methyl-7-(isoindolinyl) coumarin; 3-chloro-7-(isoindolinyl) coumarin; 4-(isoindolinyl)-4'-methylstilbene; 4-(isoindolinyl)-4'-methoxystilbene; sodium 4-(isoindolinyl)-4'-stilbenesulfonate; 4-(isoindolinyl)-4'-phenylstilbene; 4-(isoindolinyl)-3-methoxy-4'-methylstilbene; 4-(2-chloroisoindolinyl)-4'-(2-methylisoindolinyl)-2,2'-stilbenedisosulfonic acid; disodium 4,4'-diisoindolinyl-2,2'-stilbene disulfonate; 4,4'-diisoindolinyl-2,2'-stilbenedisulfonamide; disodium 4,4'-(7,8-dichloro-1-isoindolinyl)2,2-stilbenedisulfonate; disodium 4,4'-(7-chloro-1-isoindolinyl)2,2-stilbenedisulfonate; disodium 4,4'-(6-isopropoxy-1-isoindolinyl)2,2-stilbenedisulfonate; disodium 4,4'-(7,8-diisopropyl-1-isoindolinyl)2,2-stilbenedisulfonate; disodium 4,4'-(7-butoxy-1-isoindolinyl) 2,2-stilbenedisulfonate; disodium 4,4'-(6-trifluoromethyl-1-isoindolinyl)2,2-stilbenedisulfonate; disodium 4,4'-[6-(1,4,7-trioxanonyl)-1-isoindolinyl)]2,2-stilbenedisulfonate; disodium 4,4'-(7-methoxymethyl-1-isoindolinyl)2,2-stilbenedisulfonate; disodium 4,4'-(6-phenyl-1-isoindolinyl) 2,2-stilbenedisulfonate; disodium 4,4'-(6-naphthyl-1-isoindolinyl)2,2-stilbenedisulfonate; disodium 4,4'-(6-methylsulfonyl-1-isoindolinyl)2,2-stilbenedisulfonate; disodium 4,4'(7-cyano-1-isoindolinyl)2,2-stilbenedisulfonate; and disodium 4,4'-[7-(1,2,3-trihydroxypropyl)-1-isoindolinyl)]2,2-stilbenedisulfonate; disodium 4-isoindolinyl-4'-ethoxy-2,2'-stilbenedisulfonate; disodium 4-isoindolinyl-4'-methoxy-2,2'-stilbenedisulfonate; disodium 4-isoindolinyl-4'-ethoxy-2,2'-stilbenedisulfonamide; disodium 4-isoindolinyl-4'-methyl- 2,2'-stilbenedisulfonamide; disodium 4,4'-bis-(2-diethanolamino-4-anilino-s-triazin-6-ylamino)stilbene-2:2 disulphonate, disodium 4,4'-bis-(2-morpholino-4-anilino-s-triazin-6-ylamino)-stilbene-2:2'-disulphonate, disodium 4,4'-bis-(2,4-dianilino -s-triazin-6-ylamino)-stilbene-2-sulphonate, monosodium 4,4"-bis-(2,4-dianilino -s-triazin-6-ylamino)-stilbene-2:2'-disulphonate, disodium 4,4'-bis-(2-anilino-4-(N-methyl-N-2-hydroxyethylamino)-s-triazin-6-ylamino)stilbene-2,2'disulphonate, disodium 4,4'-bis-(4-phenyl-2,1,3-triazol-2-yl)-stilbene-2,2' disulphonate, disodium 4,4'-bis-(2-anilino-4-(1-methyl-2-hydroxyethylamino)-s-triazin-6-ylamino)-stilbene-2,2'-disulphonate, sodium 2-(stilbyl-4"-(naphtho-1',2', 4,5)-1,2,3-triazole-2"-sulphonate, 4,4'-bis-(2-sulphostyryl)-biphenyl, 4,4'-bis(4-phenyl-2H-1,2,3-triazol-2-yl-2,2'-stilbenedisulfonic acid and mixture thereof. See also U.S. Pat. No. 3,646,015, U.S. Pat. No. 3,346,502 and U.S. Pat. No. 3,393,153 for further examples of brighteners useful herein.

Indeed one of the functionally equivalent derivative salts of 4,4'-bis(4-phenyl-2H-1,2,3-triazol-2-yl)-2,2'-stilbenedisulfonic acid, namely its sodium salt is available from Mobay Chemical Corporation, a subsidiary of Bayer AG under the name Phorwite® CAN. The amine salt is available from Molay under the name Phorwite® CL solution. The potassium salt is available under the name Phorwite® BHC 766.

Specific examples of hydrophilic optical brighteners useful in the present invention are those having the structural formula:

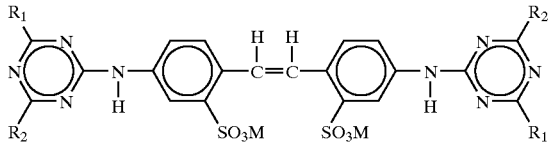

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis f(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Another preferred brightener is Optiblanc BRB available from 3V Sigma.

Other substituted stilbene 2,2'-disulfonic acid derivatives also include 4-4'-bis (2' styryl sulfonate) biphenyl, commercially available from Ciba-Geigy under the trade name Brightener 49® or other hydrophilic brighteners like for example Brightener 3® or Brightener 47®, also commercially available from Ciba-Geigy.

Specific examples of hydrophobic brighteners useful in the present invention include the polycyclic oxazole derivatives such as benzo-oxazole derivatives, or mixtures thereof and particularly preferred herein the benzo-oxazole derivatives.

An example of such a brightener is benzoxazole,2,2'-(thiophenaldyl)bis having the following formula C18H10N2O2S, commercially available from Ciba-Geigy under the trade name Tinopal SOP®. This brightener is almost insoluble in water, i.e. it has a solubility being lower than 1 gram per liter. Another example of such a brightener is bis(sulfobenzofuranyl)biphenyl, commercially available from Ciba-Geigy under the trade name Tinopal PLC®.

By "hydrophobic brighteners", it is to be understood herein any brightener whose solubility in water is lower than 10 grams per liter at 25° C. By "solubility" of a given compound, it is to be understood herein the amount of said compound solubilized in deionized water at 25° C. Thus, a compound having a solubility being lower than 10 grams per liter means that when less than 10 grams of said given compound is incorporated in deionized water at 25° C. said compound is entirely dissolved in said water, i.e. a clear and stable solution is obtained. In other words, incorporating 10 grams per liter or more of said given compound in water will result in a precipitation of said compound in said medium. Accordingly, by "hydrophilic brighteners", it is to be understood herein any brightener whose solubility in water is higher or equal to 10 grams per liter at 25° C.

Where present, brightener is incorporated at a level of from 0.001% to 1.0%, preferably from 0.005% to 0.5%, more preferably from 0.005% to 0.3% and most preferably from 0.008% to 0.1%, by weight of the composition.

Where hydrophobic brighteners are present in the compositions herein they may both be solubilized or suspended in the compositions of the present invention. Such brighteners solubilisation can be for example achieved by means of a surfactant or a mixture thereof as described herein after. Various surfactants may be used for this purpose like $C_8$–$C_{20}$ alkyl aryl sulphonates as described for example in U.S. Pat. No. 4,623,476 or amine oxides as described for example in EP-A-186386. Preferred surfactants also called "co-surfactants" to solubilise and/or suspend such a hydrophobic brightener are anionic surfactants including alkyl sulphates or alkylalkoxy sulphates having from 4 to 30 carbon atoms in the alkyl chain, or alkylethoxycarboxylates having from 6 to 30 carbon atoms in the alkyl chain such as Akyposoft® 100 NV from Chemy or Sandosan LNCS from Sandoz. Preferred are C12–C14 alkyethoxysulphates.

Such co-surfactants herein should be used in amounts required to solubilize the hydrophobic brightener in need thereof.

Generally, when a co-surfactant is used, the liquid compositions of the present inventions are prepared in a process wherein the hydrophobic brightener and the co-surfactant are first mixed to form a premix, before the premix is then mixed with the remainder of the composition which has been separately prepared.

Alternatively, the hydrophobic brightener may be suspended by means of a specific suspending agent, like polymers and/or colloidal particulate silicate. Any polymers known to those skilled in the art as having suspending properties are suitable for use herein including those described for example in ER-A-206718.

Chelating Agents

In the compositions of the present invention, the presence of a chelating agent in addition to radical scavenger is not compulsory, but is highly preferred.

It is believed that the presence of a chelating agent in the compositions of the present invention further contributes to the brightener stability upon prolonged periods of storage, and thus to the effective whiteness performance of these compositions upon ageing.

Suitable chelating agents may be any of those known to those skilled in the art such as the ones selected from the group comprising phosphonate chelating agents, phosphate chelating agents, polyfunctionally-substituted aromatic chelating agents, ethylenediamine N,N'-disuccinic acids, or mixtures thereof.

Chelating agents may be desired in the compositions of the present invention, preferably phosphate chelating agents like phytic acid, as they further contribute to the benefit delivered by the radical scavengers herein by further improving the stability of the brighteners, thus delivering effective whiteness performance in any laundry application upon ageing of the compositions, i.e. after prolonged periods of storage.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Suitable phosphate chelating agents are as following: Phosphonic acid can be condensed in the reaction

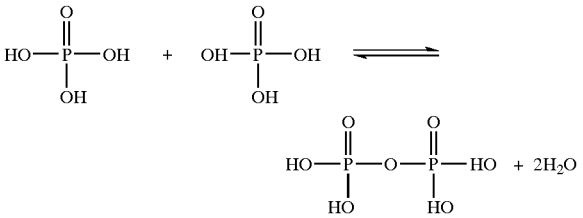

The reaction can be repeated with any of the reactive OH groups, and phosphate ingredients are obtained which can be linear or branched polyphosphates of structure

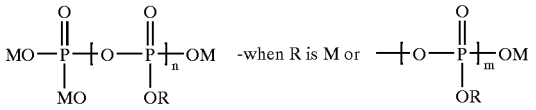

when M is a counterion, preferably alkali metal;

when O<n+m<500 (if n+m=0 then the compound is phosphonic acid)

cyclic polyphosphates (also referred to as metaphosphates), of structure

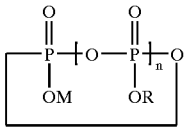

when R is M or

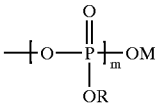

if R is

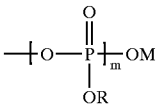

the phosphate compound contains both cycles and branched chain, and can be referred to as an ultraphosphate.)

where M is a counterion, preferably an alkali metal where O<n+m<500

All such phosphate ingredients are suitable for use herein, and preferred are linear phosphate ingredients (i.e. R is M) where n is 1 (pyrophosphate) and n is 2 (tripolyphosphate (STPP)), most preferably where n is 2. The most commonly available form of these phosphate is where M is Sodium.

Phytic acid, which is particularly suitable for use herein, is a hexa-phosphoric acid that occurs naturally in the seeds of many cereal grains, generally in the form of the insoluble calcium-magnesium salt. It may also be derived from corn steep liquor. Commercial grade phytic acid is commercially available from J.T. Baker Co., e.g. as a 40% aqueous solution. It is intended that the present invention covers the acidic form of phytic acid as well as alkali metal salt derivatives thereof, particularly sodium or potassium salts thereof. Sodium phytate is available from Jonas Chemical Co (Brooklyn, N.Y.), In fact since the typical pH of the compositions of the present invention are in the alkaline pH range, the phytic acid component exists primarily as the ionized salt in the liquid compositions herein even if it is added in its acidic form. Mixtures of such salts of phytic acid are also covered.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in US Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Particularly preferred chelating agents for use herein are phosphate chelating agents like sodium pyrophosphate, sodium tripolyphosphate, phytic acid, and mixtures thereof.

Typically, the compositions according to the present invention comprise up to 10%, preferably from 0.01% to 5% by weight, more preferably from 0.05% to 2% and most preferably from 0.1% to 1.5% by weight of the composition.

pH

The pH of the liquid compositions according to the present invention, as is, is typically from 12 to 14 measured at 25° C. The liquid compositions of the invention have a pH of from 7.5 to 13, preferably from 8 to 12, more preferably from 8.5 to 11.5, when diluted into 1 to 500 times its weight of water. It is in this alkaline range that the optimum stability and performance of the hypohalite as well as fabric whiteness and/or safety are obtained. The pH range is suitably provided by a buffering component.

Suitable sources of alkalinity are the caustic alkalis such as sodium hydroxide, potassium hydroxide and/or lithium hydroxide, and/or the alkali metal oxides such as sodium and/or potassium oxide. A preferred strong source of alkalinity is a caustic alkali, more preferably sodium hydroxide and/or potassium hydroxide. Typical levels of such caustic alkalis, when present, are of from 0.1% to 1.5% by weight, preferably from 0.5% to 1.5% by weight of the composition.

Optional pH Buffering Components

In the compositions of the present invention, the presence of a pH buffering component is not compulsory, but is preferred.

It is believed that the presence of a pH buffering component in the compositions of the present invention further contributes to the effective whiteness performance of these compositions as well as to the fabric safety. Indeed, the pH buffering component allows to control the alkalinity in the bleaching solution, i.e. maintain the pH of the bleaching solution at a pH of at least 7.5, preferably at least 8.5, and more preferably at least 9.5 for a longer period of time starting from the moment at which the dilution is completed (e.g. when the bleaching composition of the present invention is diluted in the bleaching solution at a dilution level of 200:1 (water:composition)). It is believed that the pH buffering component may also contribute to brightener stability, where present, and thus to the effective whiteness performance of the compositions herein.

The pH buffering component ensures that the pH of the composition is buffered to a pH value ranging from 7.5 to 13, preferably from 8 to 12, more preferably from 8.5 to 11.5 after the composition has been diluted into 1 to 500 times its weight of water.

Suitable pH buffering components for use herein are selected from the group consisting of alkali metal salts of carbonates, polycarbonates, sesquicarbonates, silicates, polysilicates, boron salts, phosphates, stannates, alluminates and mixtures thereof. More preferably alkali metal salts of carbonate, silicate and borate The preferred alkali metal salts for use herein are sodium and potassium.

Suitable boron salts or mixtures thereof for use herein include alkali metal salts of borates and alkyl borates and mixtures thereof. Examples of boron salts include boric acid, alkali metal salts of metaborate, tetraborate, octoborate, pentaborate, dodecaboron, borontrifluoride and alkyl borate containing from 1 to 12 carbon atoms, preferably from 1 to 4. Suitable alkyl borate includes methyl borate, ethyl borate and propyl borate. Particularly preferred boron salts herein are the alkali metal salts of metaborate, such as sodium metaborate, potassium metaborate, and the alkali metal salts of borate, such as sodium borate, or mixtures thereof. Boron salts like sodium metaborate and sodium tetraborate are commercially available from Borax and Societa Chimica Larderello under the name sodium metaborate and Borax®.

Particularly preferred pH buffering components are selected from the group consisting of sodium carbonate, sodium silicate, sodium borate, sodium metaborate and mixtures thereof.

The raw materials involved in the preparation of hypohalite bleaches usually contain by-products, e.g. calcium carbonate resulting in an amount of up to 0.4% by weight of by-product within the hypohalite composition. However, at such amount, the by-product will not have the buffering action defined above.

Liquid bleaching compositions herein will contain an amount of pH buffering component of from 0.5% to 9% by weight, preferably from 0.5% to 5% by weight, and more preferably in an amount of from 0.6% to 3% by weight of the composition.

The composition according to the invention may comprise other optional components such as bleach-stable surfactants, organic or inorganic alkalis, builders, thickening agents, polymers, pigments, dyes, solvents, perfumes, and mixtures thereof.

Surfactants

The liquid compositions of the present invention may comprise a surfactant as a desirable optional ingredient. Said surfactants may be present in the compositions according to the present invention in amounts of from 0.1% to 50%, preferably from 0.1% to 40% and more preferably from 1% to 30% by weight of the composition.

Surfactants suitable for use herein include anionic surfactants, nonionic surfactants, cationic surfactants, amphoteric surfactants, zwitterionic surfactants, and mixtures thereof.

In a particularly preferred embodiment the surfactant is selected from the group consisting of alkyl sulphate, alkyl ether sulphate and mixtures thereof.

Suitable anionic surfactants for use in the compositions herein include water-soluble salts or acids of the formula $ROSO_3M$ wherein R preferably is a $C_{10}$–$C_{24}$ hydrocarbyl, preferably linear or branched alkyl having a $C_{10}$–$C_{20}$ alkyl component, more preferably a $C_{12}$–$C_{18}$ linear or branched alkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Other suitable anionic surfactants for use herein are water-soluble salts or acids of the formula $RO(A)_mSO_3M$ wherein R is an unsubstituted $C_6$–$C_{24}$ linear or branched alkyl group having a $C_6$–$C_{24}$ alkyl component, preferably a $C_{10}$–$C_{20}$ linear or branched alkyl, more preferably $C_{12}$–$C_{18}$ linear or branched alkyl, A is an ethoxy or propoxy unit, m is greater than zero, typically between about 0.5 and about 30, more preferably between about 0.5 and about 5, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)$ sulfate, $C_{12}$–$C_{18}$ alkyl polyethoxylate (2.25) sulfate, $C_{12}$–$C_{18}$E (2.25) sulfate, $C_{12}$–$C_{18}$ alkyl polyethoxylate (3.0) sulfate, $C_{12}$–$C_{18}$E (3.0) sulfate, and $C_{12}$–$C_{18}$ alkyl polyethoxylate (4.0) sulfate, $C_{12}$–$C_{18}$E (4.0) sulfate, wherein the counterion is conveniently selected from sodium and potassium.

In a particularly preferred embodiment of the present invention the surfactant system used is an anionic surfactant system, namely alkyl alkoxy (preferably ethoxy) sulphate alone for example alkyl (ethoxy) 3 sulphate or in combination with a co-surfactant, preferably a C2–C10 alkyl sulphate and/or a C8–C22 alkyl or aryl sulphonate like C8–C22 benzene sulphonate and/or another alkyl alkoxy sulphate apart the 3 ethoxylated one. Indeed the presence of said alkyl (ethoxy) 3 sulphate alone or in combination with a cosurfactant provides the desired viscosity to the present compositions and delivers excellent stain removal properties to said compositions especially when used in any laundry application.

Typically such compositions according to the present invention have a viscosity between 25 cps and 1500 cps, preferably between 50 cps and 1100 cps, depending from the ratio between $AE_3S$ and the co-surfactant, when measured with a rheometer like carri-med CSL2-100® at the following viscosity parameters:angle:1°58, gap:60, diameter: 4.0 cm, iner : 63.60 at a temperature of 25° C. and a shear rate of 30 1/sec.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14}$–$C_{16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_k CH_2COO\text{-}M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants for use herein also include acyl sarcosinate or mixtures thereof, in its acid and/or salt form, preferably long chain acyl sarcosinates having the following formula:

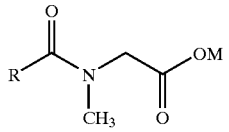

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable nonionic surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohol) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Accordingly suitable nonionic synthetic surfactants include:

(i) The polyethylene oxide condensates of alkyl phenols, e.g., the condensation products of alkyl phenols having an alkyl group containing from 6 to 20 carbon atoms in either a straight chain or branched chain configuration, preferably from 8 to 12 carbon atoms, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octane, and nonane;

(ii) Those derived from the condensation of ethylene oxide with the product resulting from the reaction of propylene oxide and ethylene diamine products which may be varied in composition depending upon the balance between the hydrophobic and hydrophilic elements which is desired. Examples are compounds containing from about 40% to about 80% polyoxyethylene by weight and having a molecular weight of from about 5000 to about 11000 resulting from the reaction of ethylene oxide groups with a hydrophobic base constituted of the reaction product of ethylene diamine and excess propylene oxide, said base having a molecular weight of the order of 2500 to 3000;

(iii) The condensation product of aliphatic alcohols having from 6 to 22 carbon atoms, in either straight chain or branched chain configuration, preferably from 8 to 18 carbon atoms, with from 2 to 35 moles of ethylene oxide, preferably from 4 to 25 and more preferably from 5 to 18. Example of this type of material are a coconut alcohol ethylene oxide condensate having from 5 to 18 moles of ethylene oxide per mole of coconut alcohol, the coconut alcohol fraction having from 9 to 14 carbon atoms;

(iv) Trialkyl amine oxides and trialkyl phosphine oxides wherein one alkyl group ranges from 10 to 18 carbon atoms and two alkyl groups range from 1 to 3 carbon atoms; specific example is tetradecyl dimethyl phosphine oxide;

(v) The condensation products of ethylene oxide with a hydrophobic base formed by the condensation of propylene oxide with propylene glycol; The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide.

Particularly suitable nonionic surfactants for use herein are capped nonionic ethoxylated surfactants according to the formula:

$$R_1(OR_2)_nOR_3$$

wherein $R_1$ is a $C_8$–$C_{18}$ linear or branched alkyl or alkenyl group, aryl group, alkaryl group, preferably, $R_1$ is a $C_{10}$–$C_{15}$ alkyl or alkenyl group, more preferably a $C_{10}$–$C_{15}$ alkyl group; $R_2$ is a $C_2$–$C_{10}$ linear or branched alkyl group, preferably a $C_4$ group; $R_3$ is a $C_1$–$C_{10}$ alkyl or alkenyl group, preferably a $C_1$–$C_5$ alkyl group, and n is an integer ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic ethoxylated surfactant of the above formula are those commercially available under the tradename Genapol® L 2.5 NR from Hoechst, and Symperonic® LF/CS 1100 from ICI.

Other suitable nonionic surfactants for use herein include the amine oxides corresponding to the formula:

$$RR'R''N\rightarrow O$$

wherein R is a primary alkyl group containing 6–24 carbons; preferably 10–18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10–18 carbons and R' and R" are both methyl. Exemplary of the preferred amine oxides are the N-hexyldimethylamine oxide, N-octyldimethylamine oxide, N-decyldimethylamine oxide, N-dodecyl dimethylamine oxide, N-tetradecyldimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Other suitable nonionic surfactants for the purpose of the invention are the phosphine or sulfoxide surfactants of formula:

$$RR'R''A\rightarrow O$$

wherein A is phosphorus or sulfur atom, R is a primary alkyl group containing 6-24 carbons, preferably 10–18 carbons, and wherein R' and R" are, each, independently selected from methyl, ethyl and 2-hydroxyethyl. The arrow in the formula is a conventional representation of a semi-polar bond.

Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred zwitterionic detergent compounds have the formula:

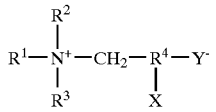

wherein R1 is an alkyl radical containing from 8 to 22 carbon atoms, R2 and R3 contain from 1 to 3 carbon atoms, R4 is an alkylene chain containing from 1 to 3 carbon atoms, X is selected from the group consisting of hydrogen and a hydroxyl radical, Y is selected from the group consisting of carboxyl and sulfonyl radicals and wherein the sum of R1, R2 and R3 radicals is from 14 to 24 carbon atoms.

Amphoteric and ampholytic detergents which can be either cationic or anionic depending upon the pH of the system are represented by detergents such as dodecylbetaalanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference. Additional synthetic detergents and listings of their commercial sources can be found in McCutcheon's Detergents and Emulsifiers, North American Ed. 1980, incorporated herein by reference.

Cationic surfactants suitable for use in compositions of the present invention are those having a long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)_y]_2R^5N^+X^-$$

wherein $R_2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH_2CH_2$—, and mixtures thereof; each $R^4$ is selected from the group consisting of $C_1$–$C_4$ alkyl, benzyl ring structures formed by joining the two $R^4$ groups, and hydrogen when y is not 0; $R^5$ is the same as $R^4$ or is an alkyl chain wherein the total number of carbon atoms of $R_2$ plus $R^5$ is not more than about 18; each y is from 0 to about 10 and the sum of the y values is from 0 to about 15; and X is any compatible anion.

Quaternary ammonium surfactant suitable for the present invention has the formula (I):

Formula I

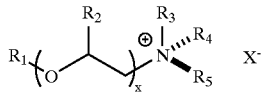

whereby R1 is a short chainlength alkyl (C6–C10)

y is 2–4, preferably 3.

whereby $R_2$ is H or a C1–C6 alkyl, whereby x is 0–4, preferably 0–2, most preferably 0, whereby R3, R4 and R5 are either the same or different and can be either a short chain alkyl (C1–C3) or alkoxylated alkyl of the formula II, whereby $X^-$is a counterion, preferably a halide, e.g. chloride or methylsulfate.

Formula II

78

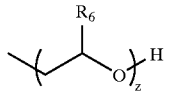

R6 is $C_1$–$C_4$ and z is 1 or 2.

Preferred quat ammonium surfactants are those as defined in formula I whereby $R_1$ is $C_8$, $C_{10}$ or mixtures thereof, x=o, $R_3$, $R_4$, $R_5$=$CH_3$.

Highly preferred cationic surfactants are the water-soluble quaternary ammonium compounds useful in the present composition having the formula:

$$R_1R_2R_3R_4N^+X^- \quad (i)$$

wherein. $R_1$ is $C_8$–$C_{16}$ alkyl, each of $R_2$, $R_3$ and $R_4$ is independently $C_1$–$C_4$ alkyl, benzyl, and —$(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and the anion X may be selected from halide, methosulphate, acetate and phosphate ions.

Examples of suitable quaternary ammonium compounds of formulae (i) for use herein are:

coconut trimethyl ammonium chloride or bromide;

decyl triethyl ammonium chloride;

$C_{12-15}$ trimethyl ammonium chloride or bromide;

myristyl trimethyl ammonium methyl sulphate;

lauryl dimethyl benzyl ammonium chloride or bromide;

lauryl dimethyl (ethenoxy)$_4$ ammonium chloride or bromide;

choline esters (compounds of formula (i) wherein $R_1$ is

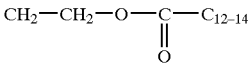

alkyl and $R_2R_3R_4$ are methyl).

Other cationic surfactants useful herein are also described in U.S. Pat. No. 4,228,044, Cambre, issued Oct. 14, 1980 and in European Patent Application EP 000,224.

Polymers

An optional component of the compositions herein is a polymer. Suitable polymers for use herein comprise monomeric units selected from the group consisting of unsaturated carboxylic acids, polycarboxylic acids, sulphonic acids, phosphonic acids and mixtures thereof. Co-polymerisation of the above monomeric units among them or with other co-monomers such as styrenesulfonic acid is also suitable.

Preferred examples of such polymers are the polymers and co-polymers of monomeric units selected from the group consisting of acrylic acid, maleic acid, vinylsulphonic acid and mixtures thereof. Also suitable for use herein are the above mentioned polymers and co-polymers which are modified in order to contain other functional groups such as aminophosphonic and/or phosphonic units. More preferred polymers are selected from the group consisting of polyacrylate polymers, co-polymers of acrylic and maleic acid, co-polymers of styrene sulphonic acid and maleic acid, and mixtures thereof, preferably modified with aminophosphonic and/or phosphonic groups.

The molecular weight for these polymers and co-polymers is preferably below 100,000, most preferably between 500 and 50,000. Most suitable polymers and co-polymers for use herein will be soluble in an amount up to 0.1% by weight, in an aqueous composition comprising 5% by weight of sodium hypochlorite with its pH adjusted to 13 with sodium hydroxide.

Commercially available such polymers, suitable for use herein, are the polyacrylate polymers sold under the tradename Good-Rite® from BF Goodrich, Acrysol® from Rohm & Haas, Solcalan® from BASF, Norasol® from Norso Haas. Also suitable for use herein are the co-polymers of styrene sulphonic acid and maleic acid, commercially available under the tradename Versaflex® from National Starch such as Versaflex 157, as well as Acumer® terpolymers from Rohm and Haas, in particular Acumer® 3100. Preferred commercially available polymers are the polyacrylate polymers, especially the Norasol® polyacrylate polymers and more preferred are the polyacrylate polymer Norasol® 410N (MW 10,000) and the polyacrylate polymer modified with phosphonic groups Norasol® 440N (MW 4000) and its corresponding acid form Norasol® QR 784 (MW 4000).

A preferred polymer for use herein is a polyacrylate polymer modified with phosphonic groups commercially available under the tradename Norasol® 440N (MW 4000) and its corresponding acid form Norasol® QR 784 (MW 4000) from Norso-Haas.

Mixtures of polymers as herein described may also be used in the present invention.

Polymers herein are preferably present in low amounts, i.e. in amounts of up to 10%, preferably up to 1%, more preferably up to 0.5% by weight, even more preferably from 0.001% to 0.3% by weight, and most preferably from 0.005% to 0.2% by weight of the composition.

Method of Bleaching Fabrics:

Particularly preferred surfaces to be bleached with the compositions herein are fabrics including for example clothes, curtains, drapes, bed linens, bath linens, table cloths, sleeping bags, tents, upholstered furniture and the like, and carpets.

Thus, the present invention further encompasses a method of bleaching fabrics which comprises the step of contacting said fabrics with a bleaching composition according to the present invention. In a preferred embodiment, the compositions used in said method of bleaching fabrics are liquid hypochlorite-containing compositions that may further comprise a chelating agent and/or a pH buffering component as defined hereinbefore. Said method according to the present invention delivers effective whiteness performance upon ageing of the compositions.

The compositions according to the present invention are applied to fabrics in a liquid form. Indeed, by "in a liquid form", it is meant herein the liquid compositions according to the present invention per se in neat or diluted form.

The compositions according to the present invention are typically used in diluted form in a laundry operation. By "in diluted form", it is meant herein that the compositions for the bleaching of fabrics according to the present invention may be diluted by the user, preferably with water. Such dilution may occur for instance in hand laundry applications as well as by other means such as in a washing machine, Said compositions can be diluted up to 500 times, preferably from 5 to 200 times and more preferably from 10 to 80 times.

More specifically, the method of bleaching fabrics according to the present invention comprises the steps of first contacting said fabrics with a bleaching composition according to the present invention, in its diluted form, then allowing said fabrics to remain in contact with said composition, for a period of time sufficient to bleach said fabrics, typically 1 to 60 minutes, preferably 5 to 30 minutes, then rinsing said fabrics with water. If said fabrics are to be washed, i.e., with a conventional composition comprising at least one surface active agent, said washing may be conducted together with the bleaching of said fabrics by contacting said fabrics at the same time with a bleaching composition according to the present invention and said detergent composition, or said washing may be conducted before or after that said fabrics have been bleached.

In another embodiment of the present invention the method of bleaching fabrics comprises the step of contacting fabrics with a liquid bleaching composition according to the present invention, in its neat form, and allowing said fabrics to remain in contact with said bleaching composition for a period of time sufficient to bleach said fabrics, typically 5 seconds to 30 minutes, preferably 1 minute to 10 minutes before rinsing said fabrics with water. If said fabrics are to be washed, i.e., with a conventional composition comprising at least one surface active agent, said washing may be conducted before or after that the fabrics have been bleached with the composition herein. In the embodiment of the present invention wherein the liquid bleaching composition of the present invention, is applied to the fabrics in its neat form, it is preferred that the level of hypohalite bleach, is from 0.01% to 5%, preferably from 0.1% to 3.5%, more preferably from 0.2% to 2% and most preferably from 0.2% to 1%, It is preferred to perform the bleaching methods herein before said fabrics are washed. Indeed, it has been observed that bleaching said fabrics with the compositions according to the present invention (diluted and/or neat bleaching methods) prior to washing them with a detergent composition provides superior whiteness and stain removal with less energy and detergent than if said fabrics are washed first, then bleached.

Alternatively instead of following the neat bleaching method as described herein above (pretreater application) by a rinsing step with water and/or a conventional washing step with a liquid or powder conventional detergent, the bleaching pre-treatment operation may also be followed by the diluted bleaching method as described herein before either in bucket (hand operation) or in a washing machine.

EXAMPLES

| | I | II | III | IV | V | VI | VII | VIII | IX | X | XI | XII | XIII | XIV | XV | XVI |
|---|---|---|---|---|---|---|---|---|---|---|---|---|---|---|---|---|
| NaOCl (as % w/w AvCl2) | 3 | 3 | 3 | 3 | 5 | 5 | 5 | 5 | 5 | 5 | 5 | 5 | 5 | 5 | 5 | 5 |
| NaOH (% w/w) | 0.5 | 1 | 1 | 1 | 0.5 | 1 | 1 | 1 | 0.5 | 1 | 1 | 1 | 0.5 | 1 | 1 | 1 |
| Na2CO3 (% w/w) | 0 | 0 | 1 | 1.5 | 0 | 0 | 1 | 1.5 | 0 | 0 | 1 | 1.5 | 0 | 0 | 1 | 1.5 |
| Silicate (% w/w SiO2) | 0 | 0.5 | 0 | 0.5 | 0 | 0.5 | 0 | 0.5 | 0 | 0.5 | 0 | 0.5 | 0 | 0.5 | 0 | 0.5 |
| Borate (% w/w) | 0 | 0 | 1 | 1 | 0 | 0 | 1 | 1 | 0 | 0 | 1 | 1 | 0 | 0 | 1 | 1 |
| NaC12/14E3S | 0 | 0 | 0 | 0 | 0 | 0 | 0 | 0 | 5 | 5 | 5 | 5 | 0 | 5 | 5 | 0 |
| C12/14dimethyl amine oxide | 0 | 0 | 0 | 0 | 0.5 | 0.5 | 0.5 | 0.5 | 0 | 0.5 | 0 | 0 | 0 | 0.5 | 0 | 2 |
| NaC12/14S | 0 | 0 | 0 | 0 | 0 | 0 | 0 | 0 | 0.5 | 0 | 0.5 | 0.5 | 5.0 | 0 | 0.5 | 0.5 |
| Tinopal PLC | 0 | 0 | 0 | 0 | 0 | 0.01 | 0 | 0.1 | 0.01 | 0.01 | 0 | 0 | 0.01 | 0 | 0.01 | 0.05 |
| Optiblanc BRB | 0 | 0 | 0 | 0 | 0 | 0 | 0 | 0 | 0 | 0.01 | 0 | 0 | 0 | 0.01 | 0.01 | 0 |
| tetramethoxy benzoic acid | 0.5 | 0 | 0.5 | 0.5 | 0.5 | 0 | 0.5 | 0.5 | 0.5 | 0 | 0.5 | 0.5 | 0.5 | 0 | 0.5 | 0.5 |
| Polystyrene sulfonate | 0 | 1.0 | 0.5 | 0.5 | 0 | 1.0 | 0.5 | 0.5 | 0 | 1.0 | 0.5 | 0.5 | 0 | 1.0 | 0.5 | 0.5 |
| Fragrance | 0.1 | 0.1 | 0.1 | 0 | 0.1 | 0.1 | 0.1 | 0 | 0.1 | 0.1 | 0.1 | 0 | 0.1 | 0.1 | 0.1 | 0 |

Wherein:

NaC12/14E3S is a C12/14 alkyl ethoxy (3) sulfate sodium salt, e.g., Empicol ESC3 from Albright & Wilson.

C12/14 dimethylamine oxide is for example industrially available from Albright & Wilson NaC12/14S is C12/14 alkyl sulphate Tinopal PLC available from Ciba Geigy Optiblanc BRB available from 3V sigma Tetramethoxy benzoic acid is for example available as reagent grade from Aldrich Polystyrene sulphonate is available as Versaflex from National Starch Fragrances can contain terpenes, esters, ethers and alcohols These examples of the present invention are not intended to limit the scope of the claimed invention in any way.

What is claimed is:

1. A liquid cleaning composition comprising:

a) from 0.1% to 20% by weight, of an oxidising agent; and b) from 0.001% to 10% by weight, of a radical scavenger, said scavenger selected from the group consisting of:

(I)

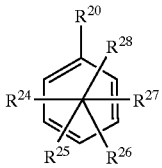

wherein $R^{20}$ is the moiety —COOM or —$SO_3M$, wherein M is hydrogen or a metal; $R^{24}$, $R^{25}$, $R^{26}$, and $R^{27}$ are each independently $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof; $R^{28}$ is hydrogen, $C_1$–$C_{10}$ linear or branched alkyl, —OR' wherein R' is $C_1$–$C_{10}$ linear or branched alkyl, —COOM, —$SO_3M$, —Cl, —Br, —$NO_2$, and mixtures thereof;

(iii) homopolymerx or copolymers comprising units having the formula:

(a)

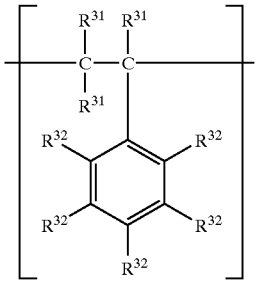

(b)

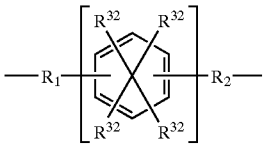

(c)

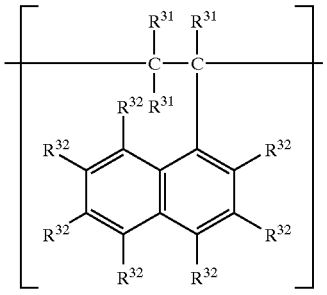

(d)

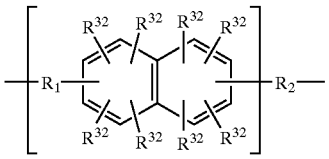

wherein $R^{31}$ is the moiety hydrogen, $C_1$–$C_{10}$ linear or branched alkyl, —OR' wherein R' is $C_1$–$C_{20}$ linear or branched alkyl, —OH, —COOM, —$SO_3M$, —Cl, —Br, —$NO_2$, and mixtures thereof; wherein M is hydrogen or a metal; each $R^{32}$ is independently hydrogen, $C_1$–$C_{10}$ linear or branched alkyl, —OR' wherein R' is $C_1$–$C_{20}$ linear or branched alkyl, —COOM, —$SO_3M$, —Cl, —Br, —$NO_2$, and mixtures thereof; $R_1$ and $R_2$ are each independently selected from —$C(R^{31})_2$—, —CO—, —C(O)O—, —C(O)NH—, —O—, —$N^+(R^{31})_2$—;

(iv) and mixtures thereof.

2. A composition according to claim 1 comprising from 0.25% to 8% by weight, of said oxidising agent.

3. A composition according to claim 2 comprising from 0.5% to 6% by weight, of said oxidising agent.

4. A composition according to claim 1 comprising from 0.01% to 8% by weight, of said scavenger.

5. A composition according to claim 4 comprising from 0.1% to 6% by weight, of said scavenger.

6. A composition according to claim 1 comprising from 0.2% to 4% by weight, of said scavenger.

7. A composition according to claim 1 wherein said oxidising agent is a source of hydrogen peroxide selected from the group consisting of percarbonates, persilicates, persulphates, perborates, peroxyacids, and mixtures thereof.

8. A composition according to claim 7 wherein said peroxyacid is diperoxydodecandioic acid, perphthalic acid, perlauric acid, perbenzoic acid, alkylperbenzoic arid, or mixtures thereof.

9. A composition according to claim 1 wherein said oxidising agent is hydrogen peroxide.

10. A composition according to claim 1 wherein said radical scavenger is selected from the group consisting of 2,3,4,5 tetramethoxy benzoic acid; 2,3,4,5,6-pentamethoxy benzoic acid; and mixtures thereof.

11. A composition according to claim 1 further comprising from 60% to 98% weight, of water.

12. A composition according to claim 11 comprising from 80% to 97% weight, of water.

13. A composition according to claim 12 comprising from 85% to 97% weight, of water.

14. A composition according to claim 1 further comprising from 0.1% to 50% by weight, of a surfactant.

15. A composition according to claim 1 further comprising from 0.001% to 1% of an optical brightener.

16. A liquid cleaning composition comprising:

a) from 0.1% to 20% by weight, of an oxidising agent; and b) from 0.001% to 10% by weight, of a radical scavenger, said radical scavenger is selected from the group consisting of 2,3,4,5 tetramethoxy benzoic acid 2,3,4,5,6-pentamethoxy benzoic acid; and mixtures thereof.

17. A composition according to claim 16 wherein said oxidising agent is a source of hydrogen peroxide selected from the group consisting of percarbonates, persilicates, persulphates, perborates, peroxyacids, and mixtures thereof.

18. A composition according to claim 1 wherein said oxidising agent is hydrogen peroxide.

19. A liquid cleaning composition comprising:

a) from 0.1% to 20% by weight, of hydrogen peroxide;

b) from 0.001% to 10% by weight, of a radical scavenger, said radical scavenger is selected from the group consisting of 2,3,4,5 tetramethoxy benzoic acid; 2,3,4,5,5-pentamethoxy benzoic acid; and mixtures thereof; and c) the balance water.

20. A method for cleaning hard surfaces comprising the step of contacting a surface with a liquid cleaning composition according to claim 1.

* * * * *